US011717978B2

(12) United States Patent
Hamaki et al.

(10) Patent No.: US 11,717,978 B2
(45) Date of Patent: Aug. 8, 2023

(54) CEMENTED CARBIDE AND CUTTING TOOL INCLUDING SAME AS SUBSTRATE

(71) Applicant: SUMITOMO ELECTRIC INDUSTRIES, LTD., Osaka (JP)

(72) Inventors: Kensei Hamaki, Osaka (JP); Takato Yamanishi, Osaka (JP); Keiichi Tsuda, Osaka (JP)

(73) Assignee: Sumitomo Electric Industries, Ltd., Osaka (JP)

( * ) Notice: Subject to any disclaimer, the term of this patent is extended or adjusted under 35 U.S.C. 154(b) by 227 days.

(21) Appl. No.: 17/414,023

(22) PCT Filed: Aug. 11, 2020

(86) PCT No.: PCT/JP2020/030541
§ 371 (c)(1),
(2) Date: Jun. 15, 2021

(87) PCT Pub. No.: WO2021/106276
PCT Pub. Date: Jun. 3, 2021

(65) Prior Publication Data

US 2022/0048213 A1 Feb. 17, 2022

(30) Foreign Application Priority Data

Nov. 26, 2019 (JP) ..... 2019-213275

(51) Int. Cl.
*C22C 29/08* (2006.01)
*B26D 1/00* (2006.01)
(Continued)

(52) U.S. Cl.
CPC ..... *B26D 1/0006* (2013.01); *C22C 1/051* (2013.01); *C22C 19/03* (2013.01); *C22C 19/07* (2013.01);
(Continued)

(58) Field of Classification Search
CPC ..... C22C 29/08
See application file for complete search history.

(56) References Cited

U.S. PATENT DOCUMENTS

2004/0187639 A1 9/2004 Kobayashi
2009/0044415 A1 2/2009 Fujino
2019/0233922 A1 8/2019 Kido et al.

FOREIGN PATENT DOCUMENTS

CN 110168121 A 8/2019
JP 2004-292905 A 10/2004
(Continued)

*Primary Examiner* — Alexandra M Moore
(74) *Attorney, Agent, or Firm* — Renner, Otto, Boisselle & Sklar, LLP

(57) ABSTRACT

A cemented carbide includes a first hard phase and a binder phase. The first hard phase is composed of tungsten carbide grains. The binder phase includes cobalt and nickel as constituent elements. An arbitrary surface or arbitrary cross section of the cemented carbide has: a region R1 interposed between an interface between the tungsten carbide grains and the binder phase and an imaginary line A; a region R2 interposed between the imaginary line A and an imaginary line B; and a region R3 other than the region R1 and R2. When a line analysis is performed in a range including the region R1 and the region R3 adjacent to the region R1 with the region R2, a ratio $C_5/C_{20}$ of a maximum atomic concentration $C_5$ at % of cobalt in the region R1 and a maximum atomic concentration $C_{20}$ at % of cobalt in the region R3 is more than 1.

8 Claims, 6 Drawing Sheets

(51) Int. Cl.

| | |
|---|---|
| ***C22C 1/051*** | (2023.01) |
| ***C22C 19/03*** | (2006.01) |
| ***C22C 19/07*** | (2006.01) |
| ***C22C 29/06*** | (2006.01) |

(52) U.S. Cl.
CPC ..... *C22C 29/067* (2013.01); *C22C 29/08* (2013.01); *B26D 2001/002* (2013.01)

(56) References Cited

FOREIGN PATENT DOCUMENTS

| | | | |
|---|---|---|---|
| JP | 2011-099164 | A | 5/2011 |
| JP | 2012-251242 | A | 12/2012 |
| JP | 2019-090098 | A | 6/2019 |
| JP | 2019-151875 | A | 9/2019 |

× 500000

× 2000000

CEMENTED CARBIDE AND CUTTING TOOL INCLUDING SAME AS SUBSTRATE

TECHNICAL FIELD

The present disclosure relates to a cemented carbide and a cutting tool including the cemented carbide as a substrate. The present application claims a priority based on Japanese Patent Application No. 2019-213275 filed on Nov. 26, 2019, the entire content of which is incorporated herein by reference.

BACKGROUND ART

Conventionally, a cemented carbide including a hard phase having tungsten carbide (WC) as a main component and a binder phase having an iron group element (for example, Fe, Co, Ni) as a main component has been used as a material of a cutting tool. Characteristics required for the cutting tool include: strength (for example, deflective strength); toughness (for example, fracture toughness); hardness (for example, Vickers hardness); plastic deformation resistance; wear resistance; and the like.

CITATION LIST

Patent Literature

PTL 1: Japanese Patent Laying-Open No. 2004-292905

SUMMARY OF INVENTION

A cemented carbide according to the present disclosure includes: a first hard phase and a binder phase, wherein a content ratio of the binder phase is more than or equal to 4 wt % and less than or equal to 15 wt % with respect to the cemented carbide, the first hard phase is composed of tungsten carbide grains, the binder phase includes cobalt and nickel as constituent elements, the binder phase further includes more than or equal to 5 at % and less than or equal to 20 at % of aluminum or chromium as a constituent element, a ratio Ni/Co of an atomic concentration of the nickel and an atomic concentration of the cobalt in the binder phase is more than or equal to 0.3 and less than 3, an arbitrary surface or arbitrary cross section of the cemented carbide has

- a region R1 interposed between an interface between the tungsten carbide grains and the binder phase and an imaginary line A indicating a location separated by 5 nm from the interface to the binder phase side,
- a region R2 interposed between the imaginary line A and an imaginary line B indicating a location separated by 20 nm from the interface to the binder phase side, and
- a region R3 other than the region R1 and the region R2 in the binder phase, and when a line analysis is performed in a range including the region R1 and the region R3 adjacent to the region R1 with the region R2 being interposed between the region R3 and the region R1, a ratio $C_5/C_{20}$ of a maximum atomic concentration $C_5$ at % of the cobalt in the region R1 and a maximum atomic concentration $C_{20}$ at % of the cobalt in the region R3 is more than 1.

A cutting tool according to the present disclosure includes the cemented carbide according to the present disclosure as a substrate.

DETAILED DESCRIPTION

Figure 1:
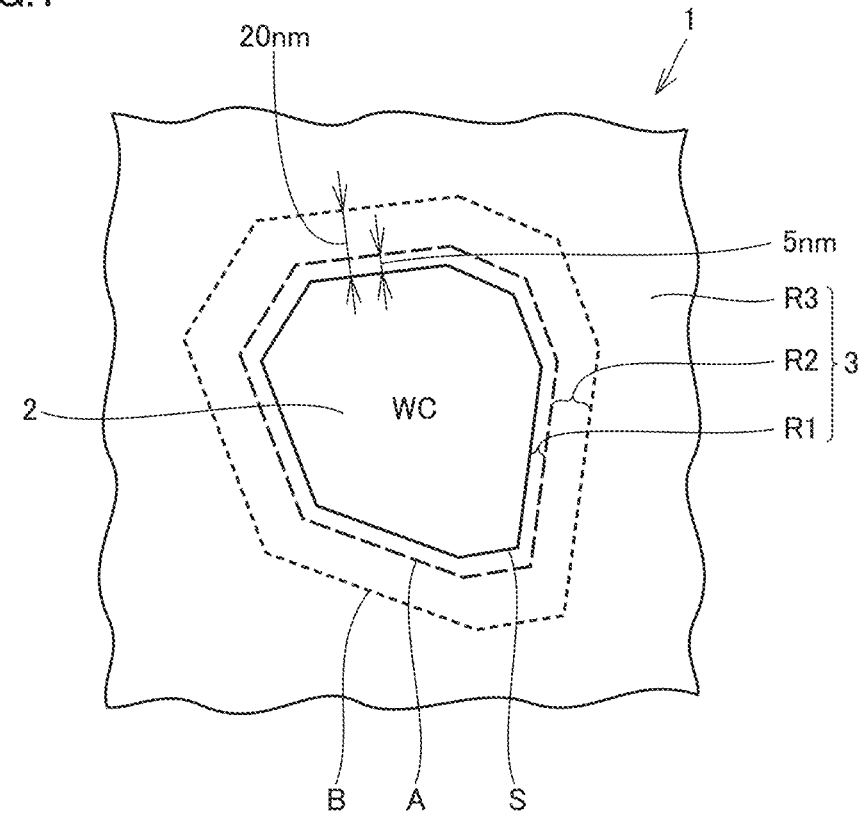
FIG. 1 is a schematic cross sectional view showing a structure of a cemented carbide according to the present embodiment.

Problems to be Solved by the Present Disclosure

Conventionally, it has been known that a cemented carbide including a large amount of Co in a binder phase has excellent strength and toughness. For example, Japanese Patent Laying-Open No. 2004-292905 (PTL 1) discloses a compositionally graded sintered alloy which comprises: 1 to 40% by weight of an iron group metal; 0.1 to 10% by weight of at least one specific metal element selected from the group consisting of Cr, Au, Ge, Cu, Sn, Al, Ga, Ag, In, Mn and Pb; a hard phase containing, as a main component, at least one compound selected from the group consisting of a carbide, a nitride and a mutual solid solution of a metal(s) which belongs to Group 4a, 5a or 6a of the Periodic Table; and inevitable impurities, wherein the content of the specific metal element gradually increases from a surface of the sintered alloy to an inner portion thereof, and a ratio of the average concentration (Cai) of the specific metal element in a region which is at least 1 mm inside from the surface of the sintered alloy, to the average concentration (Cas) of the specific metal element in a region between the surface and the position which is 0.1 mm inside the surface, of the sintered alloy, is 1.3 or more (Cai/Cas≥1.3).

In recent years, cutting tools have been used under severe conditions, such as increased difficulty in cutting workpieces and more complicated shapes to be attained by cutting. For example, in the case of cutting heat-resistant alloys such as Inconel (registered trademark) and a titanium alloy, the cutting is performed at a temperature higher than a temperature in the conventional case. Therefore, various characteristics of a cemented carbide used as a substrate of such a cutting tool have been required to be improved. In particular, a demand arises in a cemented carbide having high toughness and high hardness in processing at a high temperature.

The present disclosure has been made in view of the above circumstances, and has an object to provide a cemented carbide having an excellent mechanical characteristic at a high temperature, and a cutting tool including the cemented carbide as a substrate.

Advantageous Effect of the Present Disclosure

According to the present disclosure, there can be provided a cemented carbide having an excellent mechanical characteristic at a high temperature, and a cutting tool including the cemented carbide as a substrate.

DESCRIPTION OF EMBODIMENTS

First, contents of one embodiment of the present disclosure are listed and described.

[1] A cemented carbide according to one embodiment of the present disclosure includes a first hard phase and a binder phase, wherein a content ratio of the binder phase is more than or equal to 4 wt % and less than or equal to 15 wt % with respect to the cemented carbide, the first hard phase is composed of tungsten carbide grains, the binder phase includes cobalt and nickel as constituent elements, the binder phase further includes more than or equal to 5 at % and less than or equal to 20 at % of aluminum or chromium as a constituent element, a ratio Ni/Co of an atomic concentration of the nickel and an atomic concentration of the cobalt in the binder phase is more than or equal to 0.3 and less than 3, an arbitrary surface or arbitrary cross section of the cemented carbide has a region R1 interposed between an interface between the tungsten carbide grains and the binder phase and an imaginary line A indicating a location separated by 5 nm from the interface to the binder phase side, a region R2 interposed between the imaginary line A and an imaginary line B indicating a location separated by 20 nm from the interface to the binder phase side, and a region R3 other than the region R1 and the region R2 in the binder phase, and when a line analysis is performed in a range including the region R1 and the region R3 adjacent to the region R1 with the region R2 being interposed between the region R3 and the region R1, a ratio $C_5/C_{20}$ of a maximum atomic concentration $C_5$ at % of the cobalt in the region R1 and a maximum atomic concentration $C_{20}$ at % of the cobalt in the region R3 is more than 1.

With the cemented carbide having the above-described configuration, the cobalt is localized in the binder phase near the tungsten carbide grains (i.e., region R1). As a result, adhesion between the tungsten carbide grains and the binder phase is improved in the cemented carbide. Further, the cemented carbide has excellent heat resistance because the binder phase includes a predetermined amount of NiAl or NiCr. That is, the cemented carbide has an excellent mechanical characteristic at a high temperature.

[2] The ratio $C_5/C_{20}$ is preferably more than or equal to 1.03 and less than or equal to 2. By defining in this way, the cemented carbide has a more excellent mechanical characteristic at a high temperature.

[3] The binder phase preferably further includes tungsten as a constituent element. By defining in this way, the cemented carbide has excellent hardness at a high temperature.

[4] A ratio $N_{20}/N_5$ of a maximum atomic concentration $N_5$ at % of the nickel in the region R1 and a maximum atomic concentration $N_{20}$ at % of the nickel in the region R3 is preferably more than 1. By defining in this way, the cemented carbide has a more excellent mechanical characteristic at a high temperature.

[5] The ratio $N_{20}/N_5$ is preferably more than or equal to 1.03 and less than or equal to 1.5. By defining in this way, the cemented carbide has a more excellent mechanical characteristic at a high temperature.

[6] The cemented carbide preferably further includes a second hard phase composed of a compound including one or more metal elements selected from a group consisting of a group 4 element, a group 5 element, and a group 6 element except for tungsten in a periodic table, and one or more elements selected from a group consisting of carbon, nitrogen, oxygen, and boron. By defining in this way, when the cemented carbide is used as a material of a cutting tool, a balance between wear resistance and breakage resistance as a cutting tool can be secured.

[7] A cutting tool according to one embodiment of the present disclosure includes the cemented carbide recited in any one of [1] to [6] as a substrate. Since the cutting tool includes, as the substrate, the cemented carbide having an excellent mechanical characteristic at a high temperature, the cutting tool can implement processing to cope with a severer cutting condition such as cutting at a high temperature, and can have a long life.

[8] Preferably, the cutting tool further includes a coating film provided on the substrate. Since the coating film is provided on the surface of the substrate, wear resistance and the like of the cutting tool can be improved. Therefore, the cutting tool can cope with a further severer cutting condition and can have a longer life.

Details of Embodiments of the Present Disclosure

The following describes one embodiment (hereinafter, referred to as "the present embodiment") of the present disclosure. However, the present embodiment is not limited thereto. In the present specification, the expression "X to Y" represents a range of lower to upper limits (i.e., more than or equal to X and less than or equal to Y). When no unit is indicated for X and a unit is indicated only for Y, the unit of X is the same as the unit of Y. Further, in the present specification, when a compound is expressed by a chemical formula in which a composition ratio of constituent elements is not limited such as "TiC", it is assumed that the chemical formula includes all the conventionally known composition ratios (element ratios). In this case, it is assumed that the above-described chemical formula includes not only a stoichiometric composition but also a non-stoichiometric composition. For example, the chemical formula "TiC" includes not only a stoichiometric composition "$Ti_1C_1$" but also a non-stoichiometric composition such as "$Ti_1C_{0.8}$". The same also applies to compounds other than "TiC". In the present specification, a symbol of element or a name of element may represent a single element or may represent a constituent element in a compound.

<<Cemented Carbide>>

A cemented carbide of the present embodiment includes a first hard phase and a binder phase, wherein a content ratio of the binder phase is more than or equal to 4 wt % and less than or equal to 15 wt % with respect to the cemented carbide, the first hard phase is composed of tungsten carbide grains, the binder phase includes cobalt and nickel as constituent elements, the binder phase further includes more than or equal to 5 at % and less than or equal to 20 at % of aluminum or chromium as a constituent element, a ratio Ni/Co of an atomic concentration of the nickel and an atomic concentration of the cobalt in the binder phase is more than or equal to 0.3 and less than 3, an arbitrary surface or arbitrary cross section of the cemented carbide has a region R1 interposed between an interface between the tungsten carbide grains and the binder phase and an imaginary line A indicating a location separated by 5 nm from the interface to the binder phase side, a region R2 interposed between the imaginary line A and an imaginary line B indicating a location separated by 20 nm from the interface to the binder phase side, and a region R3 other than the region R1 and the region R2 in the binder phase, and when a line analysis is performed in a range including the region R1 and the region R3 adjacent to the region R1 with the region R2 being interposed between the region R3 and the region R1, a ratio $C_5/C_{20}$ of a maximum atomic concentration $C_5$ at % of the cobalt in the region R1 and a maximum atomic concentration $C_{20}$ at % of the cobalt in the region R3 is more than 1.

<First Hard Phase>

The first hard phase is composed of tungsten carbide (hereinafter, also referred to as "WC") grains. Here, WC includes not only "pure WC (inclusive of WC containing no impurity element at all and WC in which an impurity element is less than a detection limit)", but also "WC in which another impurity element is intentionally or inevitably included as long as the effect of the present disclosure is not compromised". The concentration of the impurity in the WC (in the case where the impurity is constituted of two or more elements, the total concentration of the two or more elements) is less than or equal to 5 mass % with respect to the total amount of the WC and the impurity.

(Average Grain Size of WC Grains)

The average grain size of the WC grains in the cemented carbide is preferably more than or equal to 0.1 μm and less than or equal to 10 μm, and is more preferably more than or equal to 0.5 μm and less than or equal to 3 μm. When the average grain size of the WC grains in the cemented carbide is more than or equal to 0.1 μm, the toughness of the cemented carbide tends to be high. Therefore, in a cutting tool including the cemented carbide as a substrate, chipping or breakage due to mechanical impact and thermal impact can be suppressed. Further, the cutting tool is improved in crack propagation resistance to suppress crack propagation, thereby suppressing chipping or breakage. On the other hand, when the average grain size is less than or equal to 10 μm, the hardness of the cemented carbide tends to be high. Therefore, in the cutting tool including the cemented carbide as a substrate, deformation during cutting is suppressed, thereby suppressing wear or breakage.

Here, the average grain size of the WC grains in the cemented carbide is determined in the following manner: an arbitrary surface or arbitrary cross section of the cemented carbide is processed to be a mirror surface, the processed surface is captured in image using a microscope, and the captured image is subjected to image analysis. Specifically, the respective grain sizes (Heywood diameters: equal-area equivalent circle diameters) of the individual WC grains are calculated from the captured image, and the average value thereof is regarded as the average grain size of the WC grains. At least 100 or more, preferably, 200 or more WC grains are subjected to the measurement. Preferably, in the same cemented carbide, the above image analysis is performed in a plurality of visual fields, and the average value thereof is regarded as the average grain size of the WC grains. The image analysis is preferably performed in 5 or more visual fields, is more preferably performed in 7 or more visual fields, is still more preferably performed in 10 or more visual fields, and is further preferably performed in 20 or more visual fields. One visual field may be represented by, for example, a square with 20 μm in length×20 μm in width.

Examples of the method for processing to obtain the mirror surface include: a method of polishing using a diamond paste; a method employing a focused ion beam apparatus (FIB apparatus); a method employing a cross section polisher apparatus (CP apparatus); and a method employing these in combination; and the like. In the case where the processed surface is to be captured in image using a metal microscope, the processed surface is preferably etched using a Murakami's reagent. Examples of the type of the microscope include: a metal microscope; a scanning transmission electron microscope (STEM); and the like. The image captured by the microscope is fed into a computer for the purpose of an analysis using image analysis software, thereby obtaining various types of information such as the average grain size. On this occasion, each of the WC grains in the first hard phase, the below-described binder phase, and the below-described second hard phase can be distinguished in the captured image by light and shade of color. As the image analysis software, image analysis type grain size distribution software ("Mac-View" provided by MOUNTECH) can be suitably used.

(Area Ratio of First Hard Phase)

In the cemented carbide according to the present embodiment, the area ratio of the first hard phase to the arbitrary surface or arbitrary cross section of the cemented carbide is preferably more than or equal to 85% and less than or equal to 96%. In this case, the total of the area ratio of the first hard phase and the area ratio of the below-described binder phase is 100% (a case where the cemented carbide includes the second hard phase will be described later). The area ratio of the first hard phase is determined, for example, in the same manner as in the above-described determination of the average grain size of the WC grains, as follows: the arbitrary processed surface of the cemented carbide is captured in image using a microscope and the captured image is subjected to an image analysis. That is, the area ratio of the first hard phase can be determined in the following manner: WC grains in a predetermined visual field are specified, the total of the areas of the specified WC grains is calculated by image processing, and the total of the areas of the specified WC grains is divided by the area of the visual field. Preferably, in the same cemented carbide, the above image analysis is performed in a plurality of visual fields (for example, 5 or more visual fields), and the average value thereof is regarded as the area ratio of the first hard phase. For the image processing, image analysis type grain size distribution software ("Mac-View" provided by MOUNTECH) can be suitably used. It should be noted that the "predetermined visual field" may be the same as the visual field used when determining the average grain size of the WC grains.

<<Binder Phase>>

The binder phase is a phase for binding the WC grains included in the first hard phase, for binding compounds included in the below-described second hard phase, or for binding the WC grains included in the first hard phase and the compounds included in the second hard phase. The content ratio of the binder phase is more than or equal to 4 wt % and less than or equal to 15 wt % with respect to the cemented carbide. The binder phase includes cobalt (Co) and nickel (Ni) as constituent elements.

In the present embodiment, the binder phase is preferably mainly composed of Co and Ni. The expression "the binder phase is mainly composed of Co and Ni" means that the atomic concentration of "Co and Ni included in the binder phase" with respect to the binder phase is more than or equal to 50 at % and less than or equal to 100 at %. The atomic concentration of Co and Ni included in the binder phase is preferably more than or equal to 80 at % and less than or equal to 95 at %, and is more preferably more than or equal to 82 at % and less than or equal to 90 at %.

The atomic concentration of Co included in the binder phase is preferably more than or equal to 20 at % and less than or equal to 75 at %, and is more preferably more than or equal to 25 at % and less than or equal to 45 at %.

The atomic concentration of Ni included in the binder phase is preferably more than or equal to 20 at % and less than or equal to 75 at %, and is more preferably more than or equal to 40 at % and less than or equal to 60 at %.

The atomic concentration of Ni or Co included in the binder phase can be measured by a titration method. The atomic concentration(s) of the other element(s) described later can be also measured by the titration method. The present inventors consider that each of the atomic concentrations measured by the titration method is an average atomic concentration in the entire binder phase.

In the present embodiment, a ratio Ni/Co of the atomic concentration of Ni and the atomic concentration of Co in the binder phase is more than or equal to 0.3 and less than 3, and is preferably more than or equal to 1 and less than or equal to 2.

In the present embodiment, the binder phase further includes more than or equal to 5 at % and less than or equal to 20 at % of aluminum (Al) or chromium (Cr) as a constituent element. When Al is included in the binder phase, the atomic concentration of Al included in the binder phase is preferably more than or equal to 5 at % and less than or equal to 20 at %. When Cr is included in the binder phase, the atomic concentration of Cr included in the binder phase is preferably more than or equal to 5 at % and less than or equal to 20 at %. Each of the "atomic concentration of Al" and the "atomic concentration of Cr" is an atomic concentration with respect to the binder phase.

In the present embodiment, the binder phase may further include tungsten (W) as a constituent element. The atomic concentration of W included in the binder phase is preferably more than or equal to 1 at % and less than or equal to 5 at %.

(Area Ratio of Binder Phase)

The area ratio of the binder phase to the arbitrary surface or arbitrary cross section of the cemented carbide according to the present embodiment is preferably more than or equal to 4% and less than or equal to 15%, and is more preferably more than or equal to 6% and less than or equal to 15%. When the area ratio of the binder phase falls within the above range and a below-described ratio $C_5/C_{20}$ falls within a predetermined range, the volume ratio of the first hard phase (phase having hardness higher than that of the binder phase) in the cemented carbide can be increased to result in high hardness of the cemented carbide as a whole at a high temperature as well as increased adhesion strength between the first hard phase and the binder phase.

It should be noted that the area ratio of the binder phase can be calculated in the same manner as in the measurement of the area ratio of the first hard phase, as follows: the binder phase is specified in a predetermined visual field, the total of the areas of the binder phase is calculated, and the total of the areas of the binder phase is divided by the area of the predetermined visual field. Preferably, in the same cemented carbide, the above image analysis is performed in a plurality of visual fields (for example, 5 or more visual fields), and the average value thereof is regarded as the area ratio of the binder phase.

Examples of the other element(s) in the binder phase include iron (Fe), copper (Cu), and the like. One of the other element(s) may be used or two or more of them may be used in combination. The binder phase may include tungsten and carbon, which are the constituent elements of the first hard phase, as well as other inevitable component element(s). The other element(s) in the binder phase are permitted to be included therein as long as the function as the binder phase (the function of binding the WC grains included in the first hard phase, binding the compounds included in the second hard phase, or binding the WC grains included in the first hard phase and the compounds included in the second hard phase) is not compromised. In one aspect of the present embodiment, it is understandable that the component elements other than the first hard phase and the below-described second hard phase are included in the binder phase.

(Regions R1, R2 and R3)

In the present embodiment, the binder phase is constituted of regions R1, R2 and R3. That is, the binder phase is divided into regions R1, R2 and R3. Hereinafter, this will be described in detail with reference to FIG. 1.

FIG. 1 is a schematic cross sectional view showing a structure of the cemented carbide according to the present embodiment. The schematic cross sectional view may show an arbitrary surface of a cemented carbide 1. Large part of tungsten carbide grains 2 are surrounded by a binder phase 3. In the present embodiment, binder phase 3 is divided into regions R1, R2, and R3. Region R1 is a region interposed between an interface S between tungsten carbide grains 2 and binder phase 3 and an imaginary line A indicating a location separated by 5 nm from interface S to the binder phase 3 side. Imaginary line A can be recognized as being constituted of a collection of points separated by 5 nm from interface S to the binder phase 3 side. Region R2 is a region interposed between imaginary line A and an imaginary line B indicating a location separated by 20 nm from interface S to the binder phase 3 side. Imaginary line B can be recognized as being constituted of a collection of points separated by 20 nm from interface S to the binder phase 3 side. Region R3 is a region other than region R1 and region R2 in binder phase 3.

Figure 2:
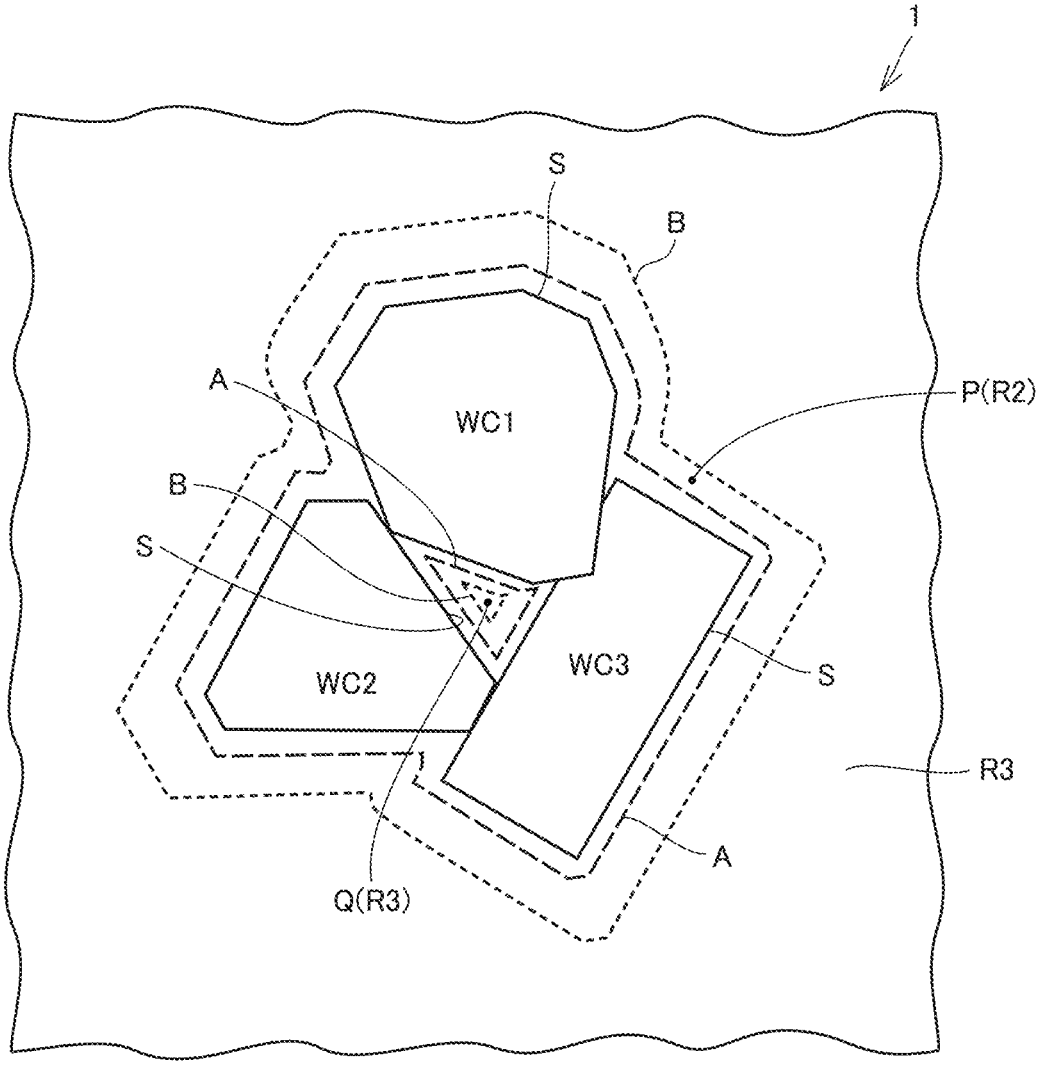
FIG. 2 is another schematic cross sectional view showing the structure of the cemented carbide according to the present embodiment.

Whether a portion of the binder phase corresponds to region R1, R2 or R3 is determined based on the closest tungsten carbide grain of the plurality of tungsten carbide grains surrounded by the binder phase. For example, a point P in FIG. 2 corresponds to region R3 based on a tungsten carbide grain WC1, but corresponds to region R2 based on a tungsten carbide grain WC3. Since tungsten carbide grain WC3 is closest to point P, it can be determined that point P is included in region R2. Further, it can be determined that a point Q corresponds to region R3 based on any one of tungsten carbide grains WC1, WC2 and WC3.

Regions R1, R2 and R3 are determined in the following manner.

Figure 3:
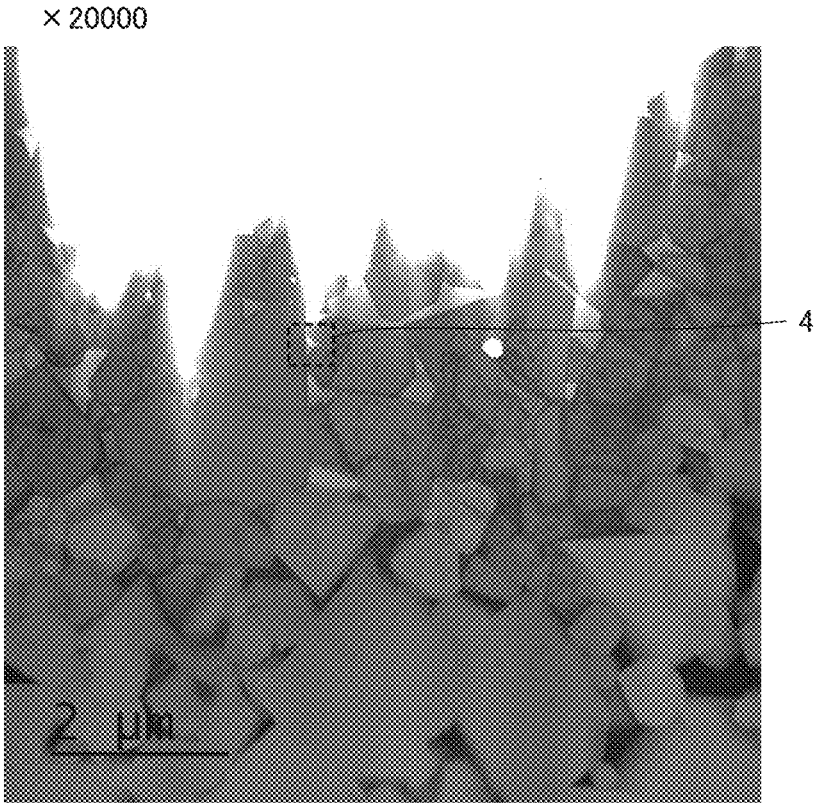
FIG. 3 shows a photograph showing a STEM image of a cross section of the cemented carbide according to the present embodiment.
Figure 4A:
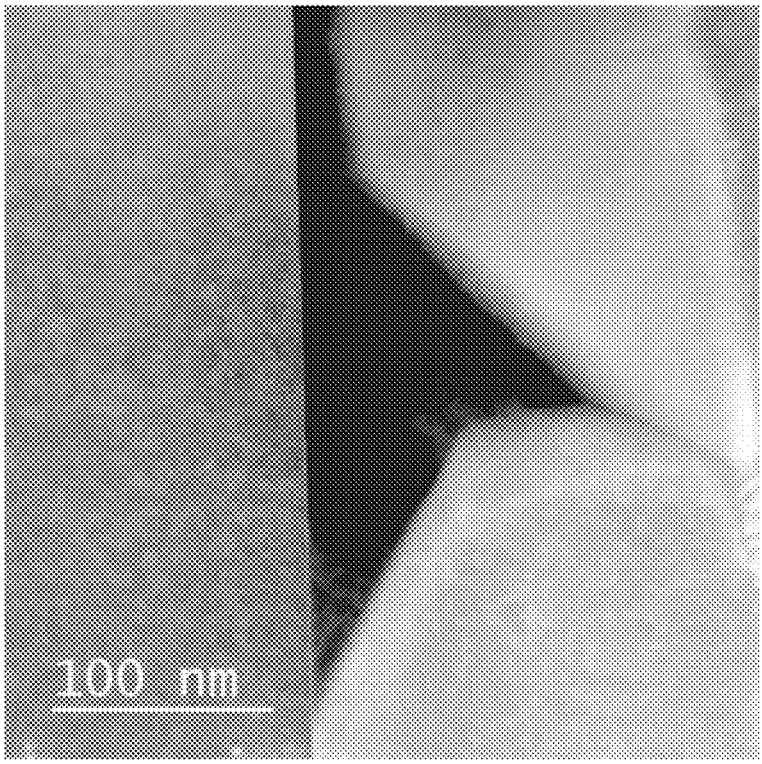
FIG. 4A shows an enlarged photograph of a region 4 in FIG. 3.
Figure 4B:
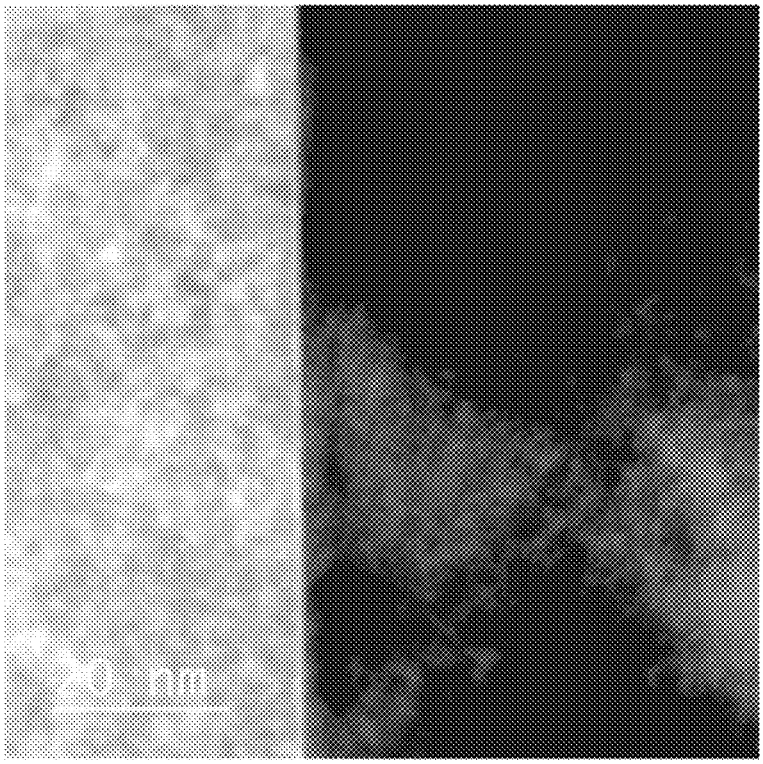
FIG. 4B shows an enlarged photograph of region 4 in FIG. 3.

First, the arbitrary surface or arbitrary cross section of the cemented carbide is observed at a low magnification using a scanning transmission electron microscope (STEM) (for example, FIG. 3). The magnification of the STEM is 20000×, for example. Here, the cross section can be formed by cutting the cemented carbide at an arbitrary position and provide the above-described mirror-surface processing onto the cut surface. In the observation at the low magnification, visual fields (for example, a visual field 4 in FIG. 3; FIG. 4A) each including WC grains and all of regions R1, R2 and R3 of the binder phase are selected. With attention paid to one of the selected visual fields, observation is performed at a high magnification (for example, 2000000×) (for example, FIG. 4B). Next, the interface between the first hard phase and the binder phase is specified based on the observed STEM image. In an annular dark-field image (ADF image) of the STEM image, the first hard phase including high-density WC is observed in white, and the binder phase having a lower density than that of the first hard phase is observed in black. Therefore, the present inventors consider that the interface between the first hard phase and the binder phase can be distinctively specified. Further, imaginary line A and imaginary line B are set based on the specified interface. Then, based on the interface, imaginary line A, and imaginary line B, the binder phase is divided into regions R1, R2 and R3.

(Ratio $C_5/C_{20}$)

In the present embodiment, when a line analysis is performed in a range including region R1 and region R3 adjacent to region R1 with region R2 being interposed therebetween, ratio $C_5/C_{20}$ of maximum atomic concentration $C_5$ at % of Co in region R1 and maximum atomic concentration $C_{20}$ at % of Co in region R3 is more than 1. Ratio $C_5/C_{20}$ is preferably more than or equal to 1.03 and less than or equal to 2, is more preferably more than or equal to 1.07 and less than or equal to 1.9, and is still more preferably more than or equal to 1.1 and less than or equal to 1.8. Ratio $C_5/C_{20}$ can be determined as follows.

First, a visual field (for example, FIGS. 4A and 4B) including all of regions R1, R2, and R3 of the binder phase is selected in the observation of the cross section of the cemented carbide by the STEM. On this occasion, region R3 is adjacent to region R1 with region R2 being interposed therebetween (for example, FIG. 2). Next, for the selected visual field, a line analysis is performed along a direction extending through interface S, imaginary line A, and imaginary line B by using an energy dispersive X-ray spectroscopy (EDS) apparatus accompanied with the STEM. Further, the "direction extending through interface S, imaginary line A, and imaginary line B" is preferably a direction perpendicular to interface S.

Figure 5:
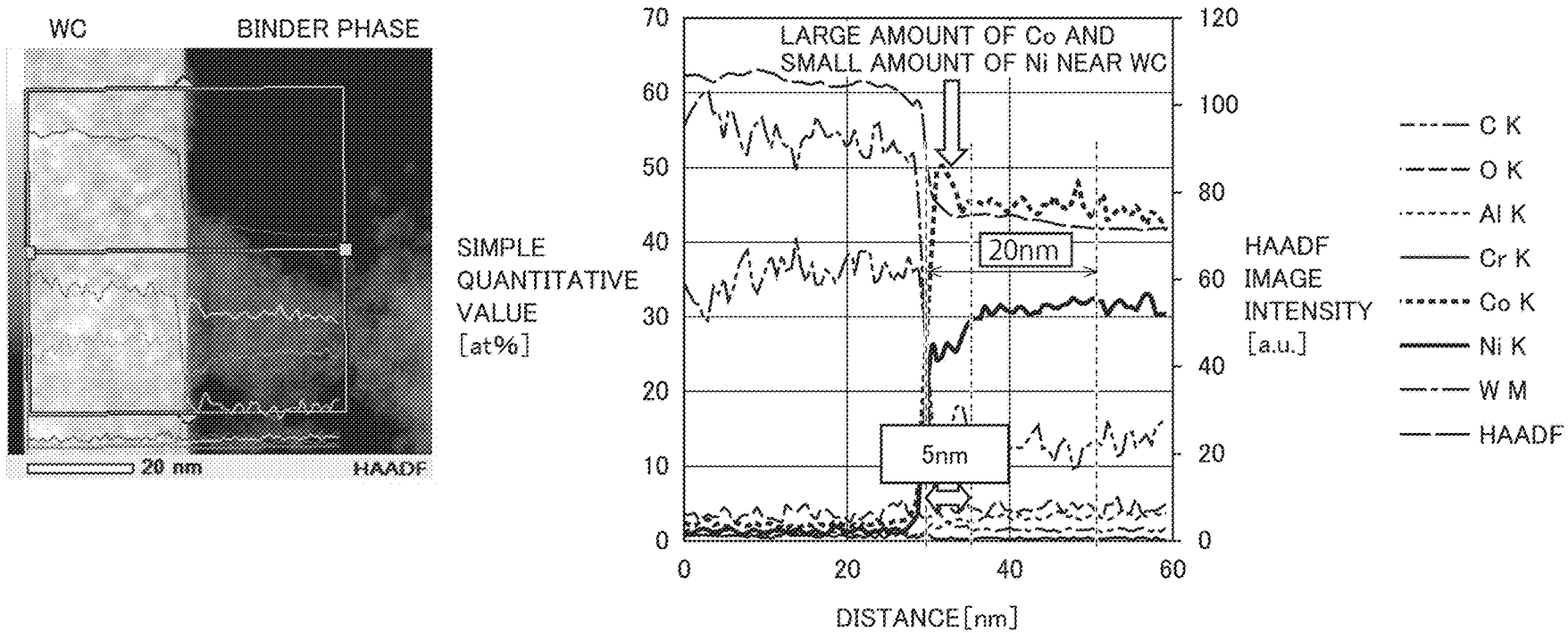
FIG. 5 shows a STEM image and an exemplary graph showing a result of a line analysis in the cemented carbide according to the present embodiment.

FIG. 5 is an exemplary graph showing a result of the line analysis in the cemented carbide according to the present embodiment. The horizontal axis represents a distance (nm) from an origin, which is set for the line analysis for the sake of convenience. The vertical axis on the left represents a quantitative value of the atomic concentration (at %) of Co or the like. Based on this graph, the maximum value of the atomic concentration of Co in a range corresponding to region R1 is regarded as maximum atomic concentration $C_5$. Further, based on the graph, the maximum value of the atomic concentration of Co in a range corresponding to region R3 is regarded as maximum atomic concentration $C_{20}$. It should be noted that in the determination of the maximum atomic concentration of Co, a point considered to apparently involve an abnormal value is not selected. Then, ratio $C_5/C_{20}$ is calculated based on obtained maximum atomic concentration $C_5$ and maximum atomic concentration $C_{20}$. Such an operation is performed for at least 5 visual fields, and the average value of ratios $C_5/C_{20}$ obtained in the respective visual fields is regarded as ratio $C_5/C_{20}$ in the cemented carbide.

(Ratio $N_{20}/N_5$)

In the present embodiment, when a line analysis is performed in the range including region R1 and region R3 adjacent to region R1 with region R2 being interposed between region R3 and region R1, ratio $N_{20}/N_5$ of maximum atomic concentration $N_5$ at % of Ni in region R1 and maximum atomic concentration $N_{20}$ at % of Ni in region R3 is preferably more than 1. Ratio $N_{20}/N_5$ is more preferably more than or equal to 1.03 and less than or equal to 1.5, and is still more preferably more than or equal to 1.07 and less than or equal to 1.47. $N_5$ and Neo can be determined by the line analysis using an EDS apparatus in the same manner as in the above-described method of calculating $C_5$ and $C_{20}$. With such a ratio $N_{20}/N_5$, the cemented carbide has more excellent toughness.

<<Second Hard Phase>>

The cemented carbide according to the present embodiment may further include a second hard phase having a composition different from that of the first hard phase. The second hard phase is preferably composed of a compound (composite compound) including: "one or more metal elements selected from a group consisting of a group 4 element, a group 5 element, and a group 6 element except for tungsten in a periodic table"; and "one or more elements selected from a group consisting of carbon (C), nitrogen (N), oxygen (O) and boron (B)". Examples of the group 4 element in the periodic table include titanium (Ti), zirconium (Zr), hafnium (Hf), and the like. Examples of the group 5 element in the periodic table include vanadium (V), niobium (Nb), tantalum (Ta), and the like. Examples of the group 6 element in the periodic table include chromium (Cr), molybdenum (Mo), and the like. The compound is mainly a carbide, nitride, carbonitride, oxide, boride, or the like of the above-listed metal element(s).

The second hard phase may be composed of grains of the above-described compound. The average grain size of the grains is preferably more than or equal to 0.05 μm and less than or equal to 2 μm, and is more preferably more than or equal to 0.1 μm and less than or equal to 0.5 μm.

The second hard phase is a compound phase or solid solution phase composed of one or more of the above compounds. Here, the expression "compound phase or solid solution phase" indicates that the compounds of such a phase may form a solid solution or may be present as individual compounds without forming a solid solution. In one aspect of the present embodiment, the binder phase surrounding the second hard phase may include a large amount of Co. That is, when the above-described regions R1, R2 and R3 are set based on the interface between the second hard phase and the binder phase, ratio $C_5/C_{20}$ of maximum atomic concentration $C_5$ at % of Co in region R1 and maximum atomic concentration $C_{20}$ at % of Co in region R3 may be more than 1.

Specific examples of the second hard phase include TaC, NbC, TiC, HfC, $Mo_2C$, and ZrC.

When the cemented carbide further includes the second hard phase, the area ratio of the first hard phase is set as the area ratio of both the first hard phase (tungsten carbide grains) and the second hard phase. That is, when the cemented carbide further includes the second hard phase, the total of the area ratio of the first hard phase and the area ratio of the second hard phase with respect to the arbitrary surface or arbitrary cross section of the cemented carbide is preferably more than or equal to 85% and less than or equal to 96%. In this case, the total of the area ratio of the first hard phase, the area ratio of the second hard phase, and the area ratio of the binder phase is 100%. The area ratio of the second hard phase can be calculated in the same manner as in the measurement of the area ratio of the first hard phase, as follows: the "second hard phase" is specified in a predetermined visual field, the total of the areas of the "second hard phase" is calculated, and the total of the areas of the "second hard phase" is divided by the area of the predetermined visual field. Preferably, in the same cemented carbide, the above image analysis is performed in a plurality of visual fields (for example, 5 or more visual fields), and the average value thereof is regarded as the area ratio of the second hard phase.

The area ratio of the second hard phase to the arbitrary surface or arbitrary cross section of the cemented carbide is preferably more than or equal to 1% and less than or equal to 10%, and is more preferably more than or equal to 2% and less than or equal to 5%. When the area ratio of the second hard phase falls within this range, occurrence of crack due to thermal impact or mechanical impact can be suppressed and oxidation resistance and reaction resistance against a workpiece can be improved while maintaining the hardness of the cemented carbide. It should be noted that when the area ratio of the second hard phase is larger than the above-described upper limit value, the strength of the cemented carbide is decreased to result in decreased toughness.

<<Method of Producing Cemented Carbide>>

The cemented carbide of the present embodiment can be produced representatively through the following steps: a source material powder preparation step→a mixing step→a molding step→a sintering step→a cooling step. Hereinafter, each step will be described.

<Preparation Step>

The preparation step is a step of preparing all the source material powders of the materials for the cemented carbide. Examples of the source material powders include: WC particles to serve as the first hard phase; and particles including Co and particles including Ni, both of which are to serve as the binder phase. Further, a compound constituent powder to serve as the second hard phase, a grain growth inhibitor, or the like may be prepared as required.

(WC Particles)

The WC particles serving as the source material are not particularly limited, and WC particles generally used for production of cemented carbides may be used. Commercially available WC particles may be used. Examples of the commercially available WC particles include "Uniform Tungsten Carbide Powder" series provided by Allied-Material; and the like.

The average particle size of the WC particles serving as the source material is preferably more than or equal to 0.3 μm and less than or equal to 10 μm, and is more preferably more than or equal to 0.3 μm and less than or equal to 5 μm. Since the average particle size of the WC particles serving as the source material is more than or equal to 0.3 μm, toughness tends to be high when the cemented carbide is formed. Therefore, in a cutting tool including the cemented carbide as a substrate, chipping or breakage due to mechanical impact and thermal impact can be suppressed. Further, the cutting tool is improved in crack propagation resistance to suppress crack propagation, thereby suppressing chipping or breakage. On the other hand, since the average particle size is less than or equal to 10 μm, hardness tends to be high when the cemented carbide is formed. Therefore, in the cutting tool including the cemented carbide as a substrate, deformation during cutting is suppressed, thereby suppressing wear or breakage.

(Particles Including Co)

The particles including Co (hereinafter, also referred to as "Co-containing particles") and serving as the source material are not particularly limited, and Co-containing particles generally used for production of cemented carbides may be used. Examples of the Co-containing particles include particles composed of Co solely (Co particles). Commercially available Co-containing particles may be used.

The average particle size of the Co-containing particles is preferably more than or equal to 0.5 μm and less than or equal to 3 μm, is more preferably more than or equal to 0.5 μm and less than or equal to 2 μm, and is still more preferably more than or equal to 0.5 μm and less than or equal to 1 μm.

(Particles Including Ni)

The particles including Ni (hereinafter, also referred to as "Ni-containing particles") and serving as the source material are preferably particles composed of a Ni alloy including Al or Cr as a constituent element. Examples of such a Ni alloy include a NiAl alloy and a NiCr alloy. Commercially available Ni-containing particles may be used.

The average particle size of the Ni-containing particles is preferably more than or equal to 0.5 μm and less than or equal to 10 μm, and is more preferably more than or equal to 0.5 μm and less than or equal to 5 μm.

(Compound Constituent Powder)

The compound constituent powder is not particularly limited, and a compound constituent powder generally used as a source material of a second hard phase in production of a cemented carbide may be used. Examples of such a compound constituent powder include TaC, TiC, NbC, $Cr_3C_2$, ZrC, TiN, and the like.

One of conditions for uniformly dispersing a second hard phase having a uniform grain size in the cemented carbide is to use a fine powder having a uniform particle size as the compound constituent powder. In this way, the second hard phase can be fine and dispersed in the below-described sintering step. The average particle size of the compound constituent powder is, for example, in a range of more than or equal to 0.5 μm and less than or equal to 3 μm. As the average particle size of the compound constituent powder used for the source material is smaller, the average grain size of the second hard phase in the finally obtained cemented carbide is smaller. As the average particle size of the compound constituent powder used for the source material is larger, the average grain size of the second hard phase in the finally obtained cemented carbide is larger. By pulverizing/classifying a commercial compound constituent powder, a fine compound constituent powder having a uniform particle size is obtained.

<Mixing Step>

The mixing step is a step of mixing the source material powders prepared in the preparation step. By the mixing step, a powder mixture having the source material powders mixed therein is obtained. It should be noted that the weight ratios of the source material powders (for example, the WC particles, the particles including Co, the particles including Ni, and the like) at the time of mixing are ratios corresponding to the area ratio of the first hard phase, the area ratio of the second hard phase, and the area ratio of the binder phase. A known apparatus can be used in the mixing step. For example, an attritor, a rolling ball mill, a Karman mixer, a bead mill, or the like can be used. An exemplary mixing condition when the attritor is used is as follows: the rotation speed is more than or equal to 100 m/min and less than or equal to 400 m/min; and the mixing time is more than or equal to 1.5 hours and less than or equal to 25 hours. The mixing by the attritor may be performed under a wet mixing condition or a dry mixing condition. Further, the mixing may be performed in a solvent such as water, ethanol, acetone, or isopropyl alcohol. The mixing may be performed with a binder such as polyethylene glycol or paraffin wax.

After the mixing step, the powder mixture may be granulated as required. By granulating the powder mixture, the powder mixture is facilitated to be introduced into a die or mold in the below-described molding step. For the granulation, a known granulation method can be applied. For example, a commercially available granulator such as a spray dryer can be used.

<Molding Step>

The molding step is a step of molding the powder mixture obtained in the mixing step into a predetermined shape to obtain a molded body. Molding method and molding condition in the molding step are not particularly limited and general method and condition may be employed. Examples of the predetermined shape include a cutting tool shape (for example, a shape of an indexable cutting insert).

<Sintering Step>

The sintering step is a step of sintering the molded body obtained in the molding step to obtain a sintered material. When Co particles are used as the particles including Co, the sintering step is preferably performed to increase the temperature to a sintering temperature at a temperature increase rate slower than a generally employed temperature increase rate. By increasing the temperature at the rate slower than the generally employed rate, the Co particles are melt prior to the Ni-containing particles, thus wetting the surfaces of the WC particles. That is, the melted Co can be localized near the WC particles. Specifically, the temperature increase rate is preferably 3 to 8° C./min.

In the sintering step, the molded body is preferably sintered at a temperature lower than a generally employed sintering temperature. When the sintering temperature is high, the Co localized near the WC particles in the course of the sintering of the molded body tends to be uniformly distributed in the binder phase due to thermal diffusion. In other words, by sintering the molded body at a temperature lower than the generally employed sintering temperature, a cemented carbide (sintered material) satisfying the above-described ratio $C_5/C_{20}$ can be obtained. Specifically, the sintering temperature is preferably more than or equal to 1300° C. and less than or equal to 1600° C. The sintering time is preferably more than or equal to 30 minutes and less than or equal to 120 minutes.

An atmosphere during the sintering is not particularly limited, and may be a $N_2$ gas atmosphere or an inert gas atmosphere such as Ar. A degree of vacuum (pressure) during the sintering is preferably less than or equal to 10 kPa, is more preferably less than or equal to 5 kPa, and is still more preferably less than or equal to 3 kPa. The lower limit of the pressure during the sintering is not particularly limited, but may be, for example, more than or equal to 0.5 kPa. When the pressure during the sintering is more than or equal to 0.5 kPa, Ni or the like can be suppressed from being volatilized from the surface of the molded body during the sintering.

It should be noted that in the sintering step, a sinter HIP process, by which pressure can be applied during the sintering, may be performed. An exemplary HIP condition is as follows: the atmosphere is a $N_2$ gas atmosphere or an inert gas atmosphere such as Ar; the temperature is more than or equal to 1300° C. and less than or equal to 1350° C.; and the pressure is more than or equal to 5 MPa and less than or equal to 200 MPa.

<Cooling Step>

The cooling step is a step of cooling the sintered material to a normal temperature after completion of the sintering. The cooling step is not particularly limited. For example, the cooling is performed at a temperature decrease rate of 1° C./min in a range of the sintering temperature to 1300° C., and is performed at a temperature decrease rate of more than or equal to 2° C./min in a range from 1300° C. to the normal temperature. Here, the expression "temperature decrease rate of 1° C./min" means that the temperature is decreased at a rate of 1° C. per minute. An atmosphere during the cooling is not particularly limited. Examples thereof include a $N_2$ gas atmosphere or an inert gas atmosphere such as Ar. A pressure during the cooling is not particularly limited. Pressure may be increased or decreased. A pressure in the case of increasing the pressure is, for example, more than or equal to 400 kPa and less than or equal to 500 kPa. A pressure in the case of decreasing the pressure is, for example, less than or equal to 100 kPa, and is preferably more than or equal to 10 kPa and less than or equal to 50 kPa. In one aspect of the present embodiment, in the cooling step, the sintered material is cooled to the normal temperature in an Ar gas atmosphere.

<<Cutting Tool, Wear-Resistant Tool and Grinding Tool>>

Since the cemented carbide of the present embodiment has excellent toughness and hardness as described above, the cemented carbide can be used as a substrate of each of a cutting tool, an wear-resistant tool, and a grinding tool. That is, the cutting tool of the present embodiment includes the cemented carbide as a substrate. Likewise, each of the wear-resistant tool and the grinding tool of the present embodiment includes the cemented carbide as a substrate.

The cemented carbide of the present embodiment is widely applicable to conventionally known cutting tool, wear-resistant tool, and grinding tool. Examples of such tools are as follows. Examples of the cutting tool include a cutting bite, a drill, an end mill, an indexable cutting insert for milling, an indexable cutting insert for turning, a metal saw, a gear cutting tool, a reamer, a tap, or the like. Examples of the wear-resistant tool include a die, a scriber, a scribing wheel, a dresser, or the like. Examples of the grinding tool include a grinding wheel, or the like.

The cemented carbide of the present embodiment may constitute a whole of each of these tools. The cemented carbide may constitute a part of each of these tools. Here, the expression "constitute a part" indicates an implementation in which, for example, in the case of the cutting tool, the cemented carbide of the present embodiment is brazed to a predetermined position of an arbitrary substrate so as to serve as a cutting edge portion.

<Coating Film>

The cutting tool according to the present embodiment may further include a coating film provided on the substrate. Each of the wear-resistant tool and the grinding tool according to the present embodiment may further include a coating film provided on the substrate. Examples of the composition of the coating film include a compound of one or more elements selected from a group consisting of a group 4 metal element in the periodic table, a group 5 metal element in the periodic table, a group 6 metal element in the periodic table, aluminum (Al), and silicon (Si), and one or more elements selected from a group consisting of nitrogen (N), oxygen (O), carbon (C) and boron (B). Examples of the compound include TiCN, $Al_2O_3$, TiAlN, TiN, TiC, AlCrN, and the like. In the present embodiment, the coating film may be a metal simple substance. In addition, cubic boron nitride (cBN), diamond-like carbon, or the like is also suitable as the composition of the coating film. Such a coating film can be formed by a vapor deposition method such as a chemical vapor deposition (CVD) method or a physical vapor deposition (PVD) method. When the coating film is formed by the CVD method, the coating film is likely to have excellent adhesion to the substrate. Examples of the CVD method include a thermal CVD method and the like. When the coating film is formed by the PVD method, compressive residual stress is applied, thus facilitating an increase in toughness of the cutting tool or the like.

The coating film in the cutting tool according to the present embodiment is preferably provided on a portion of the substrate to serve as a cutting edge and near the portion of the substrate. The coating film may be provided on the entire surface of the substrate. The coating film may be constituted of a single layer or a plurality of layers.

The thickness of the coating film may be more than or equal to 1 μm and less than or equal to 20 μm, or may be more than or equal to 1.5 μm and less than or equal to 15 μm.

The above description includes features additionally described below.

(Clause 1)

A cemented carbide comprising a first hard phase and a binder phase, wherein a content ratio of the binder phase is more than or equal to 4 wt % and less than or equal to 15 wt % with respect to the cemented carbide, the first hard phase is composed of tungsten carbide grains, the binder phase includes Co and Ni as constituent elements, the binder phase further includes more than or equal to 5 at % and less than or equal to 20 at % of Al or Cr as a constituent element, a ratio Ni/Co of an atomic concentration of the Ni and an atomic concentration of the Co in the binder phase is more than or equal to 0.3 and less than 3, an arbitrary surface or arbitrary cross section of the cemented carbide has a region R1 interposed between an interface between the tungsten carbide grains and the binder phase and an imaginary line A indicating a location separated by 5 nm from the interface to the binder phase side, a region R2 interposed between the imaginary line A and an imaginary line B indicating a location separated by 20 nm from the interface to the binder phase side, and a region R3 other than the region R1 and the region R2 in the binder phase, and when a line analysis is performed in a range including the region R1 and the region R3 adjacent to the region R1 with the region R2 being interposed between the region R3 and the region R1, a ratio $C_5/C_{20}$ of a maximum atomic concentration $C_5$ at % of the Co in the region R1 and a maximum atomic concentration $C_{20}$ at % of the Co in the region R3 is more than 1.

(Clause 2)

The cemented carbide according to clause 1, wherein the ratio $C_5/C_{20}$ of the $C_5$ and the $C_{20}$ is more than or equal to 1.03 and less than or equal to 2.

(Clause 3)

The cemented carbide according to clause 1 or 2, wherein the binder phase further includes W as a constituent element.

(Clause 4)

The cemented carbide according to any one of clauses 1 to 3, wherein a ratio $N_{20}/N_5$ of a maximum atomic concentration $N_5$ at % of the Ni in the region R1 and a maximum atomic concentration $N_{20}$ at % of the Ni in the region R3 is more than 1.

(Clause 5)

The cemented carbide according to clause 4, wherein the ratio $N_{20}/N_5$ is more than or equal to 1.03 and less than or equal to 1.5.

(Clause 6)

The cemented carbide according to any one of clauses 1 to 5, further comprising a second hard phase composed of a compound including one or more metal elements selected from a group 4 element, a group 5 element, and a group 6 element except for tungsten in a periodic table, and one or more elements selected from C, N, O, and B.

EXAMPLES

Hereinafter, the present invention will be described in detail with reference to Examples, but the present invention is not limited thereto.

<<Production of Cemented Carbide>>

<Preparation of Source Material Powders>

(Production of Ni Alloy Powder)

A powder of a Ni alloy (hereinafter, also referred to as "Ni alloy powder") serving as a source material of the binder phase was produced by the following method. The Ni alloy powder corresponds to the "Ni-containing particles" described above. First, source material powders were blended in the below-described blending composition, and the Ni alloy (a NiAl alloy, a NiCr alloy, and a NiW alloy) was produced by an atomizing method.

| Blending Composition (Weight Ratio) of Source Materials of Ni Alloy | |
|---|---|
| NiAl alloy | Ni:Al = 3:1 |
| NiCr alloy | Ni:Cr = 4:1 |
| NiW alloy | Ni:W = 10:1 |

Next, the obtained Ni alloy was pulverized by a ball mill under the below-described condition. A slurry including the Ni alloy obtained by the pulverization process was dried in atmospheric air. With the above procedure, the Ni alloy powder was obtained.

Condition of Pulverization by Ball Mill

Ball: diameter of 3.0 mm

Dispersion medium: ethanol or acetone

Process time: 24 hours (Preparation of Other Source Material Powders)

Powders having compositions shown in Table 1 were prepared as source material powders. As the source material powders used as the first hard phase, the second hard phase or the binder phase in Table 1, below-described powders were used.

The blending ratio of the Ni alloy and Co in Table 1 was appropriately adjusted to obtain the below-described composition of the binder phase in Table 3.

WC: average particle size of 0.8 μm

TaC

NbC

TiC (Ta,Ti)C

TiN

Co

NiAl: The powder obtained in the above section (Production of Ni Alloy Powder)

NiCr: The powder obtained in the above section (Production of Ni Alloy Powder)

NiW: The powder obtained in the above section (Production of Ni Alloy Powder)

TABLE 1

| Sample No. | Hard Phase: First Hard Phase Composition | Hard Phase: Second Hard Phase Composition | Binder Phase Composition |
|---|---|---|---|
| 1 | WC | None | Co, NiAl |
| 2 | WC | None | Co, NiAl |
| 3 | WC | None | Co, NiAl |
| 4 | WC | None | Co, NiAl |
| 5 | WC | None | Co, NiCr |
| 6 | WC | None | Co, NiCr |
| 7 | WC | None | Co, NiW |
| 8 | WC | None | Co, NiAl |
| 9 | WC | None | Co, NiAl |
| 10 | WC | TaC | Co, NiAl |
| 11 | WC | NbC | Co, NiAl |
| 12 | WC | TaC | Co, NiAl |
| 13 | WC | TiC | Co, NiAl |
| 14 | WC | None | Co, NiAl |
| 15 | WC | None | Co, NiAl |
| 16 | WC | None | Co, NiAl |
| 17 | WC | None | Co, NiAl |
| 18 | WC | None | Co, NiAl |
| 101 | WC | None | Co, NiAl |
| 102 | WC | None | Co, NiAl |
| 103 | WC | None | Co, NiAl |
| 104 | WC | None | Co |
| 105 | WC | (Ta, Ti)C, TiN | Co, NiAl |
| 106 | WC | None | Co, NiAl |

<Mixing of Source Material Powders>

The prepared source material powders were added at the blending ratios shown in Table 2, and were mixed using an attritor to produce a powder mixture. A mixing condition is as described below. After the mixing, an obtained slurry was dried in atmospheric air to obtain the powder mixture.

Mixing Condition for Attritor

Ball: composed of cemented carbide and having a diameter of 3.5 mm

Dispersion medium: ethanol

Rotation speed of stirrer: 100 rpm

Process time: 12 hours

<Production of Molded Body>

The obtained powder mixture was pressed and molded to produce a molded body having a shape of a model number SNG432 (provided by Sumitomo Electric Hardmetal) (indexable cutting insert).

<Sintering of Molded Body>

The obtained molded body was placed in a sintering furnace and sintering was performed in an Ar gas atmosphere (0.5 kPa) using a temperature increase rate, a sintering temperature, and a sintering time, which are shown in Table 2.

After completion of the sintering, the sintered material was cooled to a normal temperature in an Ar gas atmosphere. On this occasion, the cooling was performed at a temperature decrease rate of 1° C./min in a range from the sintering temperature shown in Table 2 to 1300° C., and was performed at a temperature decrease rate of 20° C./min in a range from 1300° C. to the normal temperature. In this way, cemented carbides of samples No. 1 to No. 18 and cemented carbides of samples No. 101 to No. 106 were produced. The cemented carbides of samples No. 1 to No. 18 correspond to examples of the present disclosure. The cemented carbides of samples No. 101 to No. 106 correspond to comparative examples.

TABLE 2

| Sample No. | Mixing Step Blending Ratio of Source: Material Powders (wt%): First Hard Phase | Second Hard Phase | Binder Phase | Sintering Step: Temperature: Increase Rate (° C./min) | Sintering Temperature (° C.) | Sintering Time (min) |
|---|---|---|---|---|---|---|
| 1 | 94 | 0 | 6 | 3 | 1420 | 60 |
| 2 | 94 | 0 | 6 | 3 | 1420 | 60 |
| 3 | 94 | 0 | 6 | 3 | 1420 | 60 |
| 4 | 94 | 0 | 6 | 3 | 1420 | 60 |
| 5 | 94 | 0 | 6 | 5 | 1420 | 60 |
| 6 | 94 | 0 | 6 | 5 | 1420 | 60 |
| 7 | 94 | 0 | 6 | 8 | 1420 | 60 |
| 8 | 96 | 0 | 4 | 3 | 1420 | 60 |
| 9 | 85 | 0 | 15 | 3 | 1420 | 60 |
| 10 | 92 | 2 | 6 | 5 | 1420 | 60 |
| 11 | 92 | 2 | 6 | 5 | 1420 | 60 |
| 12 | 84 | 10 | 6 | 5 | 1420 | 60 |
| 13 | 92 | 2 | 6 | 5 | 1420 | 60 |
| 14 | 92 | 0 | 8 | 3 | 1350 | 60 |
| 15 | 92 | 0 | 8 | 7 | 1600 | 60 |
| 16 | 94 | 0 | 6 | 3 | 1380 | 60 |
| 17 | 94 | 0 | 6 | 5 | 1380 | 60 |
| 18 | 94 | 0 | 6 | 3 | 1500 | 60 |
| 101 | 94 | 0 | 6 | 3 | 1420 | 60 |
| 102 | 94 | 0 | 6 | 3 | 1420 | 60 |
| 103 | 94 | 0 | 6 | 3 | 1420 | 60 |
| 104 | 94 | 0 | 6 | 3 | 1420 | 60 |
| 105 | 87 | 3 | 10 | 15 | 1440 | 60 |
| 106 | 94 | 0 | 6 | 5 | 1700 | 60 |

<<Observation of Samples>>

<Calculation of Average Grain Size of Tungsten Carbide Grains>

Each of the produced cemented carbides of samples No. 1 to No. 18 and samples No. 101 to No. 106 was cut, and the cut surface was processed to be a mirror surface. Thereafter, the cut surface processed to be a mirror surface was subjected to ion milling using an argon ion beam, and the cross section thereof was regarded as an observation sample for a microscope.

The processed surface of this observation sample was captured in image using a scanning transmission electron microscope (STEM) (manufactured by JEOL) at a magnification of about 2000×. For each sample, 10 visual fields were captured in image at each of the outer side of the processed surface and the center of the processed surface.

In each sample, for each one visual field, the grain sizes (Heywood diameters) of 300 or more individual tungsten carbide grains was determined using image analysis type grain size distribution software ("Mac-View" provided by MOUNTECH), and the average grain size of the tungsten carbide grains after the sintering in the total of the 10 visual fields was calculated. As a result, it was found that the average grain size of the tungsten carbide grains after the sintering was substantially equal to the average particle size of the WC particles used as the source material.

<Calculation of Area Ratio of Each of First Hard Phase, Second Hard Phase and Binder Phase>

The image analysis type grain size distribution software ("Mac-View" provided by MOUNTECH) was used to determine the area ratio of each of the first hard phase, the second hard phase, and the binder phase at the processed surface of each sample. As a result, it was found that the area ratios of the first hard phase, the second hard phase, and the binder phase correspond to the respective blending ratios (Table 2) of the source material powders corresponding to the first hard phase, the second hard phase, and the binder phase.

<Analysis on Composition of Binder Phase>

The binder phase at the processed surface of each sample was analyzed by the titration method to determine the composition of the binder phase. Results thereof are shown in Table 3.

TABLE 3

| Sample No. | Composition of Binder Phase (at %) Co | Ni | Ni/Co Ratio | Al | Cr | W |
|---|---|---|---|---|---|---|
| 1 | 71.4 | 21.4 | 0.3 | 7.1 | 0.0 | 0.0 |
| 2 | 42.9 | 42.9 | 1.0 | 14.3 | 0.0 | 0.0 |
| 3 | 27.3 | 54.5 | 2.0 | 18.2 | 0.0 | 0.0 |
| 4 | 21.1 | 59.2 | 2.8 | 19.7 | 0.0 | 0.0 |
| 5 | 47.7 | 45.4 | 1.0 | 0.0 | 6.8 | 0.0 |
| 6 | 40.9 | 45.4 | 1.1 | 0.0 | 13.6 | 0.0 |
| 7 | 47.5 | 47.5 | 1.0 | 0.0 | 0.0 | 5.0 |
| 8 | 42.9 | 42.9 | 1.0 | 14.3 | 0.0 | 0.0 |
| 9 | 42.9 | 42.9 | 1.0 | 14.3 | 0.0 | 0.0 |
| 10 | 42.9 | 42.9 | 1.0 | 14.3 | 0.0 | 0.0 |
| 11 | 42.9 | 42.9 | 1.0 | 14.3 | 0.0 | 0.0 |
| 12 | 42.9 | 42.9 | 1.0 | 14.3 | 0.0 | 0.0 |
| 13 | 42.9 | 42.9 | 1.0 | 14.3 | 0.0 | 0.0 |
| 14 | 42.9 | 42.9 | 1.0 | 14.3 | 0.0 | 0.0 |
| 15 | 42.9 | 42.9 | 1.0 | 14.3 | 0.0 | 0.0 |
| 16 | 40.0 | 42.9 | 1.1 | 17.1 | 0.0 | 0.0 |
| 17 | 40.0 | 42.9 | 1.1 | 17.1 | 0.0 | 0.0 |
| 18 | 40.0 | 42.9 | 1.1 | 17.1 | 0.0 | 0.0 |
| 101 | 20.0 | 60.0 | 3.0 | 20.0 | 0 | 0 |
| 102 | 78.7 | 16.0 | 0.2 | 5.3 | 0 | 0 |
| 103 | 38.5 | 38.5 | 1.0 | 23.0 | 0.0 | 0.0 |
| 104 | 100.0 | 0.0 | 0.0 | 0.0 | 0.0 | 0.0 |
| 105 | 50.0 | 37.5 | 0.8 | 12.5 | 0.0 | 0.0 |
| 106 | 42.9 | 42.9 | 1.0 | 14.3 | 0.0 | 0.0 |

<Calculation of Atomic Concentration of Co and Ratio $C_5/C_{20}$ in Binder Phase>

First, the processed surface of each sample was observed at a magnification of 20000× using a STEM (manufactured by JEOL) (for example, FIG. 3). On this occasion, a square with 4 μm in length×4 μm in width was regarded as one visual field. The visual field was selected such that both the first hard phase and the binder phase (regions R1, R2 and R3) were included in one visual field (for example, FIG. 4B). The magnification on this occasion was 2000000×. In the one selected visual field, an interface between the first hard phase and the binder phase was specified. Further, an imaginary line A and an imaginary line B were set based on the specified interface. Here, imaginary line A is a line indicating a location separated by 5 nm from the interface to the binder phase side. Imaginary line B is a line indicating a location separated by 20 nm from the interface to the binder phase side. Based on the interface, imaginary line A, and imaginary line B, the binder phase was divided into regions R1, R2, and R3.

Next, a line analysis was performed using an energy dispersion spectroscopy method (EDS method) along a direction extending through all of the first hard phase and regions R1, R2, and R3 of the binder phase. For the line analysis, a STEM manufactured by JEOL was used. A graph was drawn based on obtained results of the line analysis (for example, FIG. 5). In the graph, the horizontal axis represents a distance (nm) from an origin set for the line analysis for the sake of convenience, and the vertical axis represents a quantitative value of the atomic concentration (at %) of each element.

From the above graph, maximum atomic concentration $C_5$ (at %) of Co in region R1 and maximum atomic concentration $C_{20}$ (at %) of Co in region R3 were determined. Further, ratio $C_5/C_{20}$ of $C_5$ and $C_{20}$ was calculated. Such an operation was performed for 5 visual fields. The average value of ratios $C_5/C_{20}$ obtained in the respective visual fields was regarded as ratio $C_5/C_{20}$ in the sample. Results thereof are shown in Table 4. It should be noted that in the determination of the maximum atomic concentration of Co, a point considered to apparently involve an abnormal value was not selected.

<Calculation of Atomic Concentration of Ni and Ratio $N_{20}/N_5$ in Binder Phase>

For the atomic concentration of Ni in the binder phase of each sample, a line analysis was performed by the EDS method in the same manner as described above.

Maximum atomic concentration $N_5$ (at %) of Ni in region R1 and maximum atomic concentration Neo (at %) of Ni in region R3 were determined from a graph obtained based on results of the line analysis. Further, ratio $N_{20}/N_5$ of $N_5$ and $N_{20}$ was calculated. Such an operation was performed for 5 visual fields, and the average value of ratios $N_{20}/N_5$ obtained in the respective visual fields was regarded as ratio $N_{20}/N_5$ in the sample. Results thereof are shown in Table 4. It should be noted that in the determination of the maximum atomic concentration of Ni, a point considered to apparently involve an abnormal value was not selected.

From the results of ratio $C_5/C_{20}$ and ratio $N_{20}/N_5$ (Table 4), it was found that in the cemented carbides of samples No. 1 to No. 18, Co was localized and Ni was relatively small in amount near the WC grains in the binder phase (i.e., region R1).

<<Cutting Test>>

A hard film was formed on a surface of each sample by an ion plating method, which is one type of known PVD method, thereby producing a cutting tool for a cutting test. The hard film was a TiAlN film having a thickness of 4.8 μm. Hereinafter, a cutting tool using the cemented carbide of sample No. 1 as a substrate is referred to as "cutting tool of sample No. 1" or the like. The same applies to the samples other than sample No. 1.

<Cutting Test 1: Breakage Resistance Test>

Each of the cutting tools of samples No. 1 to No. 18 and samples No. 101 to No. 106 produced as described above was used to measure the number of times of applying impacts (number of times) until a breakage occurred in the cutting edge under a below-described cutting condition. Results thereof are shown in Table 4. The number of times of applying impacts in Table 4 indicates the average value of values obtained by performing the measurement four times. As the number of times of applying impacts is larger, the cutting tool can be evaluated to have more excellent breakage resistance.

Condition of Breakage Resistance Test

Workpiece: SCM 435 grooved member (the number of grooves: 3)

Cutting speed: 300 m/min

Feed amount: 0.3 mm/rev

Cut amount: 1.5 mm

Cutting oil: none

<Cutting Test 2: Wear Resistance Test>

Each of the cutting tools of samples No. 1 to No. 18 and samples No. 101 to No. 106 produced as described above was used to measure a cutting time (seconds) until a flank wear amount Vb became 0.2 mm under a below-described cutting condition. Results thereof are shown in Table 4. As the cutting time is longer, the cutting tool can be evaluated to have more excellent wear resistance. Inconel (registered trademark) 718, which is a workpiece, is a superalloy known to have high hardness. Therefore, the cutting edge during the cutting is considered to have a high temperature. In view of this, in the above cutting test, it can be also evaluated that as the cutting time is longer, the heat resistance is more excellent.

Condition of Wear Resistance Test
Workpiece: Inconel (registered trademark) 718
Cutting speed: 60 m/min
Feed amount: 0.3 mm/rev
Cut amount: 1 mm
Cutting oil: present

TABLE 4

| Sample No. | Evaluation on Characteristics $C_5$ | $C_{20}$ | $C/C_{20}$ | $N_5$ | $N_{20}$ | $N_{20}/N_5$ | Cutting Test 1 Number of Times of Applying Impact (Number of Times) | Cutting Test 2 Cutting Time (sec) |
|---|---|---|---|---|---|---|---|---|
| 1 | 75.8 | 70.8 | 1.07 | 17.4 | 21.4 | 1.23 | 2000 | 111 |
| 2 | 50.0 | 42.0 | 1.19 | 35.9 | 41.6 | 1.16 | 1900 | 115 |
| 3 | 33.4 | 26.5 | 1.26 | 48.4 | 55.7 | 1.15 | 1930 | 125 |
| 4 | 25.6 | 20.7 | 1.24 | 55.4 | 59.8 | 1.08 | 1750 | 119 |
| 5 | 57.7 | 47.7 | 1.21 | 36.5 | 43.8 | 1.20 | 1850 | 114 |
| 6 | 45.5 | 40.7 | 1.12 | 41.6 | 46.2 | 1.11 | 1750 | 103 |
| 7 | 53.5 | 46.5 | 1.15 | 41.5 | 47.7 | 1.15 | 1800 | 108 |
| 8 | 47.1 | 42.1 | 1.12 | 38.8 | 44.3 | 1.14 | 1340 | 138 |
| 9 | 49.0 | 42.2 | 1.16 | 37.2 | 44.2 | 1.19 | 2420 | 90 |
| 10 | 50.6 | 42.5 | 1.19 | 35.8 | 42.6 | 1.19 | 1880 | 136 |
| 11 | 47.8 | 42.7 | 1.12 | 38.8 | 43.5 | 1.12 | 1760 | 109 |
| 12 | 49.7 | 42.9 | 1.16 | 37.1 | 42.3 | 1.14 | 1820 | 132 |
| 13 | 48.1 | 42.2 | 1.14 | 37.9 | 42.5 | 1.12 | 1950 | 121 |
| 14 | 50.2 | 42.2 | 1.19 | 35.9 | 41.7 | 1.16 | 1540 | 125 |
| 15 | 47.3 | 42.2 | 1.12 | 38.8 | 43.5 | 1.12 | 1670 | 130 |
| 16 | 53.5 | 39.0 | 1.37 | 29.2 | 40.0 | 1.37 | 1680 | 103 |
| 17 | 60.8 | 40.0 | 1.52 | 23.4 | 34.3 | 1.47 | 1720 | 84 |
| 18 | 42.0 | 39.2 | 1.07 | 41.2 | 44.0 | 1.07 | 1600 | 98 |
| 101 | 20.0 | 20.0 | 1.00 | 60.0 | 60.0 | 1.00 | 1430 | 50 |
| 102 | 78.7 | 78.7 | 1.00 | 16.0 | 16.0 | 1.00 | 1910 | 53 |
| 103 | 38.5 | 38.5 | 1.00 | 38.5 | 38.5 | 1.00 | 1490 | 58 |
| 104 | 100.0 | 100.0 | 1.00 | — | — | — | 2150 | 45 |
| 105 | 50.0 | 50.0 | 1.00 | 37.5 | 37.5 | 1.00 | 1430 | 71 |
| 106 | 42.9 | 42.9 | 1.00 | 42.9 | 42.9 | 1.00 | 1650 | 30 |

Figure 6:
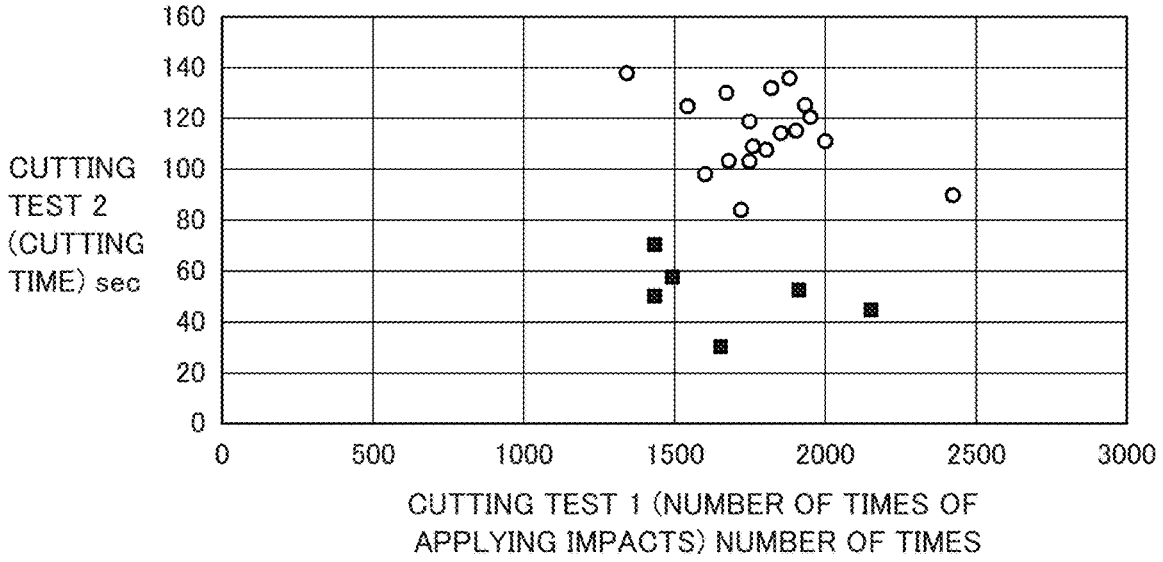
FIG. 6 is a graph showing a correlation between a result of a cutting test 1 and a result of a cutting test 2 in an Example.

A correlation between the results of cutting test 1 and cutting test 2 was shown in a graph (FIG. 6) for the purpose of review. In the graph, points represented by white circles indicate the evaluation results of samples No. 1 to No. 18 (examples of the present disclosure). Points represented by black quadrangles indicate the evaluation results of samples No. 101 to No. 106 (comparative examples).

In comparison between sample No. 2 and sample No. 106, the atomic concentrations of Co in the binder phases are almost the same. However, it was found that the cutting tool of sample No. 2 in which ratio $C_5/C_{20}$ is more than 1 has more excellent wear resistance and breakage resistance than those of the cutting tool of sample No. 106 in which ratio $C_5/C_{20}$ is less than 1. That is, it was found that the cemented carbide of sample No. 2 in which ratio $C_5/C_{20}$ is more than 1 has more excellent hardness and toughness than those of the cemented carbide of sample No. 106 in which ratio $C_5/C_{20}$ is less than 1. Further, in comparison between the cemented carbides of samples No. 1 to No. 18 (group of the examples of the present disclosure; the white circles in FIG. 6) and the cemented carbides of samples No. 101 to No. 106 (group of the comparative examples; the black quadrangles in FIG. 6), the group of the examples of the present disclosure tends to be located on the upper right side with respect to the group of the comparative examples in FIG. 6. This suggests that each of the cemented carbides according to the examples of the present disclosure has more excellent hardness and toughness than those of each of the cemented carbides according to the comparative examples, because Co serving as the constituent component of the binder phase is localized near the tungsten carbide grains serving as the first hard phase in each of the cemented carbides according to the examples of the present disclosure.

Inconel (registered trademark) 718, which is a workpiece in cutting test 2, is a superalloy known to have high hardness. Therefore, the cutting edge during the cutting is considered to have a high temperature. In view of this, it is considered that each of the cemented carbides of samples No. 1 to No. 18 has more excellent heat resistance than that of each of the cemented carbides of samples No. 101 to No. 106.

From the results of cutting tests 1 and 2, it was found that each of the cemented carbides (examples of the present disclosure) of samples No. 1 to No. 18 is more excellent than each of the cemented carbides of samples No. 101 to 106 (comparative examples) in terms of a mechanical characteristic at a high temperature.

Heretofore, the embodiments and examples of the present invention have been illustrated, but it has been initially expected to appropriately combine configurations of the embodiments and examples.

The embodiments and examples disclosed herein are illustrative and non-restrictive in any respect. The scope of the present invention is defined by the terms of the claims, rather than the embodiments and examples described above, and is intended to include any modifications within the scope and meaning equivalent to the terms of the claims.

REFERENCE SIGNS LIST

1: cemented carbide; 2: tungsten carbide grain; 3: binder phase; 4: region corresponding to the photograph of FIG. 4A; A: imaginary line A; B: imaginary line B; S: interface between tungsten carbide grain and binder phase; R1: region R1; R2: region R2; R3: region R3

The invention claimed is:

1. A cemented carbide comprising a first hard phase and a binder phase, wherein a content ratio of the binder phase is more than or equal to 4 wt % and less than or equal to 15 wt % with respect to the cemented carbide, the first hard phase is composed of tungsten carbide grains, the binder phase includes cobalt and nickel as constituent elements, the binder phase further includes more than or equal to 5 at % and less than or equal to 20 at % of aluminum or chromium as a constituent element, a ratio Ni/Co of an atomic concentration of the nickel and an atomic concentration of the cobalt in the binder phase is more than or equal to 0.3 and less than 3, an arbitrary surface or arbitrary cross section of the cemented carbide has a region R1 interposed between an interface between the tungsten carbide grains and the binder phase and an imaginary line A indicating a location separated by 5 nm from the interface to the binder phase side, a region R2 interposed between the imaginary line A and an imaginary line B indicating a location separated by 20 nm from the interface to the binder phase side, and a region R3 other than the region R1 and the region R2 in the binder phase, and a ratio $C_5/C_{20}$ of a maximum atomic concentration $C_5$ at % of the cobalt in the region R1 and a maximum atomic concentration $C_{20}$ at % of the cobalt in the region R3 is more than 1, and the maximum atomic concentration $C_5$ at % and the maximum atomic concentration $C_{20}$ at % are determined by performing a line analysis in a range including the region R1 and the region R3 adjacent to the region R1 with the region R2 being interposed between the region R3 and the region R1.

2. The cemented carbide according to claim 1, wherein the ratio $C_5/C_{20}$ is more than or equal to 1.03 and less than or equal to 2.

3. The cemented carbide according to claim 1, wherein the binder phase further includes tungsten as a constituent element.

4. The cemented carbide according to claim 1, wherein a ratio $N_{20}/N_5$ of a maximum atomic concentration $N_5$ at % of the nickel in the region R1 and a maximum atomic concentration $N_{20}$ at % of the nickel in the region R3 is more than 1.

5. The cemented carbide according to claim 4, wherein the ratio $N_{20}/N_5$ is more than or equal to 1.03 and less than or equal to 1.5.

6. The cemented carbide according to claim 1, further comprising a second hard phase composed of a compound including one or more metal elements selected from a group 4 element, a group 5 element, and a group 6 element except for tungsten in a periodic table, and one or more elements selected from carbon, nitrogen, oxygen, and boron.

7. A cutting tool comprising the cemented carbide recited in claim 1 as a substrate.

8. The cutting tool according to claim 7, further comprising a coating film provided on the substrate.

* * * * *